US010677254B2

(12) United States Patent
Peeters

(10) Patent No.: US 10,677,254 B2
(45) Date of Patent: Jun. 9, 2020

(54) COMPRESSOR DEVICE

(71) Applicant: ATLAS COPCO AIRPOWER, NAAMLOZE VENNOOTSCHAP, Wilrijk (BE)

(72) Inventor: Kurt Peeters, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 197 days.

(21) Appl. No.: 15/550,626

(22) PCT Filed: Feb. 1, 2016

(86) PCT No.: PCT/BE2016/000008

§ 371 (c)(1),
(2) Date: Aug. 11, 2017

(87) PCT Pub. No.: WO2016/134426

PCT Pub. Date: Sep. 1, 2016

(65) Prior Publication Data

US 2018/0245599 A1 Aug. 30, 2018

(30) Foreign Application Priority Data

Feb. 13, 2015 (BE) ..... 2015/5082

(51) Int. Cl.
*F04D 29/063* (2006.01)
*F04D 13/02* (2006.01)
(Continued)

(52) U.S. Cl.
CPC ..... *F04D 29/063* (2013.01); *F04C 28/06* (2013.01); *F04C 29/025* (2013.01);
(Continued)

(58) Field of Classification Search
CPC ..... F04D 29/063; F04D 17/10; F04D 25/02; F04D 13/021; F04C 28/06; F04C 29/025
(Continued)

(56) References Cited

U.S. PATENT DOCUMENTS 2,294,143 A 8/1942 Watson
5,848,538 A 12/1998 Tischer
(Continued)

FOREIGN PATENT DOCUMENTS

DE 511046 C 10/1930
EP 0527105 A1 2/1993

OTHER PUBLICATIONS

International Search Report (ISR) dated Sep. 15, 2016, for PCT/BE2016/000008.

*Primary Examiner* — Joseph J Dallo
*Assistant Examiner* — Scott A Reinbold
(74) *Attorney, Agent, or Firm* — Bacon & Thomas, PLLC

(57) ABSTRACT

A compressor device comprising a compressor element with a housing with, an inlet and an outlet. At least one rotor is affixed in the housing that is provided with a drive. The compressor device is provided with an oil circuit for injecting oil into the housing. The oil circuit only comprises one pump for driving the oil around in the oil circuit. This pump is coupled to a first shaft via a first disengageable coupling, more specifically a shaft of the aforementioned drive on the one hand, and to a second shaft via a second disengageable coupling, more specifically a shaft of a secondary drive on the other hand. The first and second disengageable couplings between the pump and the first shaft and between the pump and the second shaft are such that the pump is only driven by the shaft of these two shafts that has the highest speed.

14 Claims, 3 Drawing Sheets

(51) Int. Cl.

| | |
|---|---|
| ***F04C 29/02*** | (2006.01) |
| ***F04D 25/02*** | (2006.01) |
| ***F04C 28/06*** | (2006.01) |
| ***F04D 17/10*** | (2006.01) |

(52) U.S. Cl.
CPC ..... *F04D 13/021* (2013.01); *F04D 17/10* (2013.01); *F04D 25/02* (2013.01)

(58) Field of Classification Search
USPC ..... 415/1
See application file for complete search history.

(56) References Cited

U.S. PATENT DOCUMENTS

| | | | | |
|---|---|---|---|---|
| 2006/0254267 | A1* | 11/2006 | Maienschein ..... | F16H 41/24 60/345 |
| 2008/0000746 | A1* | 1/2008 | Schiele ..... | B60K 6/387 192/3.54 |
| 2008/0108469 | A1* | 5/2008 | Weinschenker .... | F16H 57/0434 475/72 |
| 2013/0156623 | A1 | 6/2013 | Bonnefoi et al. | |

* cited by examiner

COMPRESSOR DEVICE

The present invention relates to a compressor device.

More specifically, the invention concerns a compressor device for compressing gas that comprises a compressor element with a housing with an inlet and an outlet, whereby at least one rotor is affixed in the housing that is provided with a drive, whereby the compressor device is provided with an oil circuit for injecting oil into the housing.

This rotor can be a helical rotor for example, in which case it is then a screw compressor element or for example an impeller or compressor wheel when it concerns a centrifugal compressor element.

BACKGROUND OF THE INVENTION

It is known that for the cooling and/or lubrication of the compressor element use is made of oil that is injected into the housing of the compressor element.

This oil is guided around by means of an oil circuit through the compressor device.

To be able to inject the oil, the oil circuit is provided with an oil pump.

This oil pomp is driven by means of the aforementioned drive that drives the rotor.

When the compressor device is switched off, whereby the speed of the motor decreases, the oil pump will also be switched off so that no oil is injected.

However, when switching off the compressor device it is important that sufficient oil is still injected for some time.

Also when starting up the compressor device it is important that before the rotor comes into operation, the oil can already circulate to lubricate the compressor element.

In order to provide an oil supply in these situations, in known installations an additional ancillary pump with a separate drive is provided.

This auxiliary pump will come into operation when switching off and before starting up the drive of the rotor in order to provide the necessary oil injection.

Such known installations also present the disadvantage that an additional auxiliary pump and auxiliary motor must be provided, whereby separate inlet and outlet pipes have to be provided.

Another disadvantage is that non-return valves must be provided in order to counteract a backflow of oil when one of the pumps is switched off.

An additional disadvantage is that when starting up, an overpressure can occur in the oil circuit. Indeed, at the moment that the drive comes into operation, the pump will also come into operation and the auxiliary pump must be switched off. As a result too great a quantity of oil will be pumped around and injected.

Moreover, the changeover betters the pump and the auxiliary pump will cause a change in the oil supply.

SUMMARY OF THE INVENTION

The purpose of the present invention is to provide a solution to at least one of the aforementioned and other disadvantages.

The object of the present invention is a compressor device for compressing gas that comprises a compressor element with a housing with an inlet and an outlet, whereby at least one rotor is affixed in the housing that is provided with a drive, whereby the compressor device is provided with an oil circuit for injecting oil into the housing, whereby the oil circuit only comprises one pump for driving the oil around in the oil circuit, whereby this pump is coupled to a first shaft via a first disengageable coupling, more specifically a shaft of the aforementioned drive on the one hand, and to a second shaft via a second disengageable coupling, more specifically a shaft of a secondary drive on the other hand, whereby the first and second disengageable couplings between the pump and the first shaft and between the pump and the second shaft are such that the pump is only driven by the shaft of these two shafts that has the highest speed.

An advantage is that only one pump has to be provided for the oil. Extra inlet and outlet pipes do not have to be provided for this pump either.

This makes the device simpler and easier to control.

Another advantage is that there is no switching between different pumps, but that only one pump will take care of the oil supply, so that changes in the oil supply will be very small.

Indeed, the changeover of the drive by the secondary drive to the drive of the rotor and vice versa will proceed seamlessly as it were.

Moreover, a complex control will not be necessary to realise this.

Another advantage is that the secondary drive can be used to drive the pump before the drive of the rotor is started, so that the compressor element can already be lubricated.

When switching off, the secondary drive can take over the role of the drive to ensure that the pump can inject sufficient oil.

In the moot preferred embodiment the first disengageable coupling between the pump and the first shaft is realised by means of at least one freewheel coupling that is affixed on the first shaft, and the second disengageable coupling between the pump and the second shaft is realised by means of at least one freewheel coupling that is affixed on the second shaft, whereby the freewheel couplings are such that when the pump has a higher speed than the shaft concerned, the freewheel coupling will disengage the pump from the shaft concerned.

This has the advantage that the pump will be automatically disengaged from the drive when it has a lower speed than the secondary drive, whereby the secondary drive will be immediately coupled to the pump and vice versa.

It is clear that the disengageable couplings can be realised in very many different ways.

The invention also concerns a method for providing a compressor device with oil by means of a pump, whereby the pump is coupled to a first shaft of a drive via a first disengageable coupling, whereby this drive also drives a rotor of the compressor device, and is coupled to a second shaft of a secondary drive via a second disengageable coupling, whereby the method comprises the following steps:

- the determination of the speed of the first shaft and the second shaft;
- the comparison of the speeds;
- when the speed of the second shaft is greater than the speed of the first shaft, the first disengageable coupling disengages and the second disengageable coupling engages;
- when the speed of the second shaft is less than the speed of the first shaft, the second disengageable coupling disengages and the first disengageable coupling engages.

An advantage of such a method is that only one pump is required for such a method to be able to supply the compressor device with oil.

Such a method will also be easy to implement.

Another additional advantage is that the quantity of oil that is injected or driven around in the oil circuit will not fluctuate, or as good as not fluctuate, when the compressor device is switched on and off because for the operation of the pump the switching between the drive and the secondary drive will be seamless so to speak.

BRIEF DESCRIPTION OF THE DRAWINGS

With the intention of better showing the characteristics of the invention, a few preferred variants of a compressor device according to the invention and a method for supplying a compressor device with oil are described hereinafter by way of an example, without any limiting nature, with reference to the accompanying drawings, wherein:

FIG. 3 shows an alternative embodiment.

DETAILED DESCRIPTION OF THE INVENTION

Figure 1:
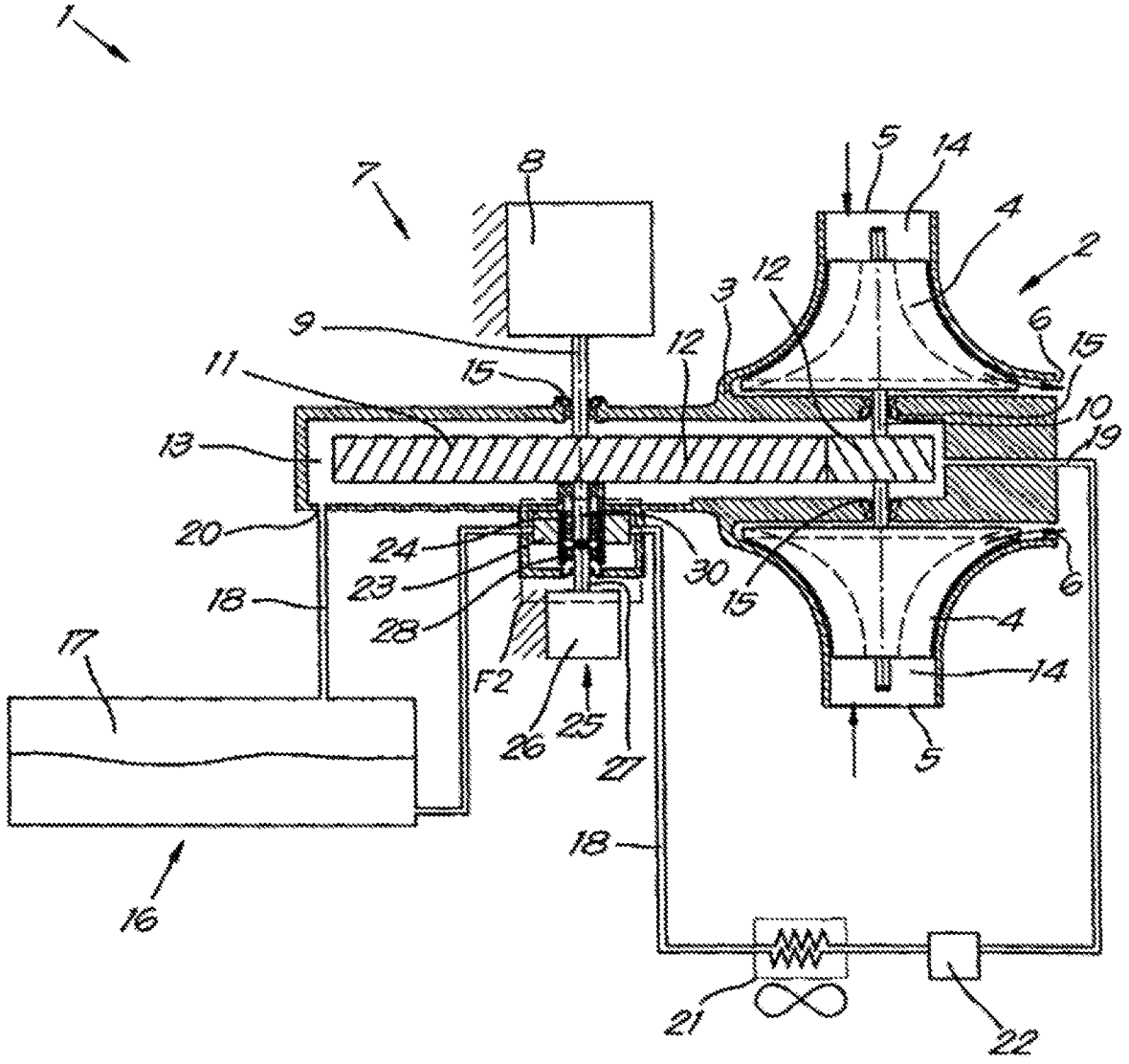
FIG. 1 schematically shows a compressor device according to the invention.

The compressor device 1 shown in FIG. 1 comprises a centrifugal compressor element 2 with a housing 3 in which in this case two rotors are affixed in the form of impeller.

It is clear that the compressor device 1 can comprise a different type of compressor element 2, such as for example a screw compressor element or turbocompressor element.

The housing 3 is provided with an inlet 5 for gas to be compressed and an outlet 6 for compressed gas.

A drive 7 is provided in order to drive the impellers 4.

This drive 7 comprises a motor 8 with a first shaft 9 that is coupled to the shaft 10 of the impellers 4 by means of a transmission 11.

In this case, this transmission 11 consists of gearwheels 12 that are affixed on the first shaft 9 and the shaft 10 of the impellers 4.

As can be seen in FIG. 1, the transmission 11 is integrated in the housing 3, in a space 13 that is closed off from the space 14 in the housing 3 where the impellers 4 are located.

The first shaft 9 or the motor 8 extends through the housing 3, and the motor 8 itself is outside the housing 3.

The necessary seals 15 are provided around the first shaft 9 and the shaft 10 of the impellers 4, in order to ensure the separation between the space 13, 14 in the housing 3 and the outside world on the one hand, and between the different spaces 13, 14 of the housing 3 mutually on the other hand.

The compressor device 1 is further provided with an oil circuit 16 to be able to inject oil into the compressor device 1 to cool and lubricate the compressor element 2.

In this case the oil will essentially be used for the lubrication and/or cooling of the gearwheels 12 of the transmission 11, or in other words the oil will be injected into the space 13 of the housing 3 where the transmission 11 is located.

If it concerns a screw compressor element, the oil is essentially used for cooling and lubricating the helical rotors.

The oil circuit 16 comprises an oil reservoir 17 that is connected via oil pipes 18 to an inlet 19 and outlet 20 for oil in the housing 3.

Furthermore, the oil circuit 16 comprises a cooler 21 for cooling the oil and an oil filter 22.

According to the invention the oil circuit 16 only comprises one pump 23 that is connected to the first shaft 9 via a first disengageable coupling 24.

A secondary drive 25 is also provided in the form of an auxiliary motor 26 with a second shaft 27 that is connected to the pump 23 via a second disengageable coupling 28.

Figure 2:
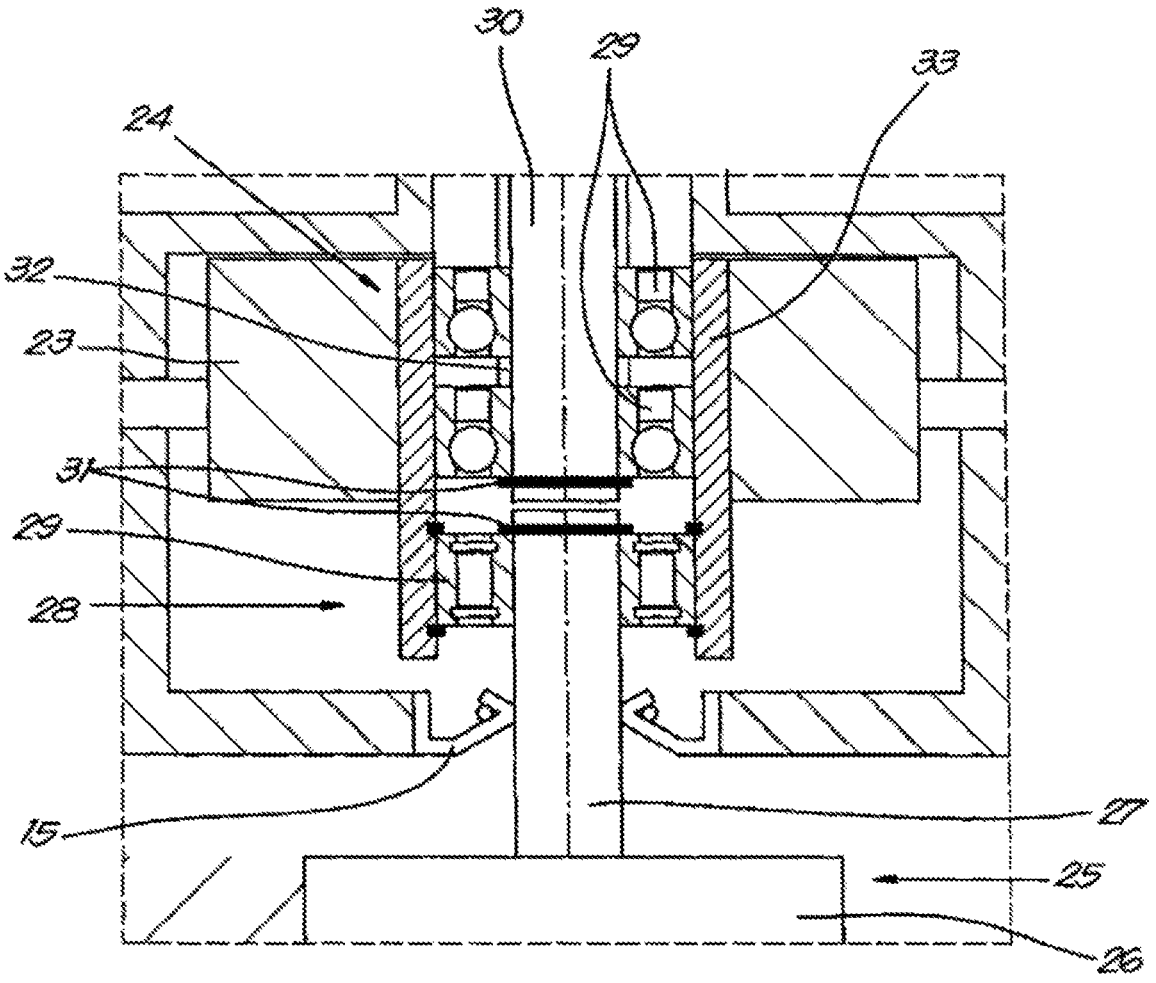
FIG. 2 shows the section indicated by F2 in FIG. 1 in more detail.
Figure 5:
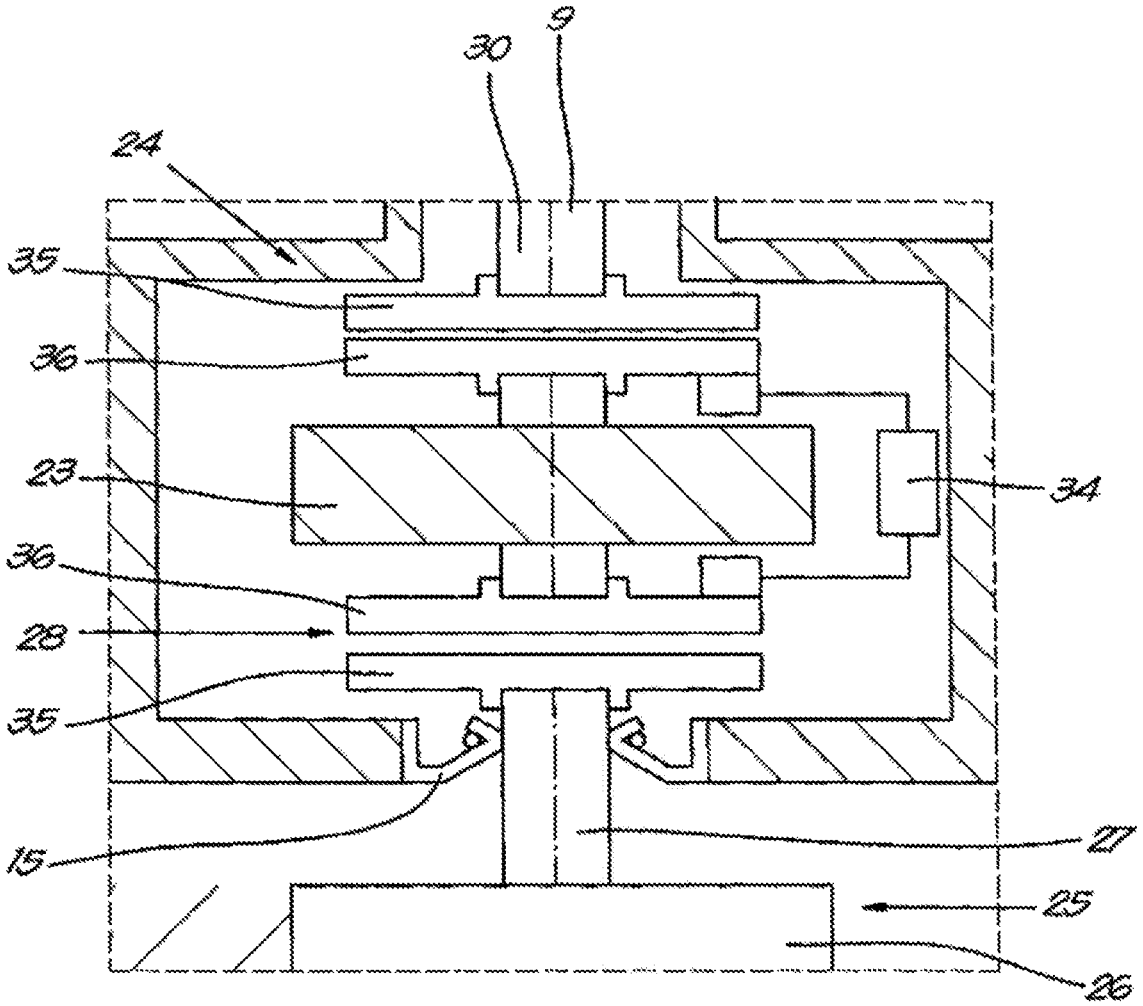

As shown in detail in FIG. 2, the first disengageable coupling 14 is realised by means of a freewheel coupling 29.

In this case, but not necessarily, it concerns two freewheel couplings 29 that are affixed on the first shaft 9, more specifically on an extended section 30 of the first shaft 9 that extends through the housing 3.

The freewheel coupling 29 is such that when the pump 23 has a higher speed than the first shaft 9, the freewheel coupling 29 will disengage the pump 23 from the first shaft 9.

Blocking means are provided at the end of the extended section 30, in this case in the form of a circlip 31, and a spacer 32 is provided between the freewheel couplings 29 that ensure that the freewheel couplings stay in place.

Analogously the second disengageable coupling 28 is realised by means of a freewheel coupling 29 that is affixed on the second shaft 27, whereby a circlip 31 is also provided that acts as a blocking means.

As can be seen in FIG. 2, the first shaft 9 and the second shaft 27 are in line with one another.

In this way it is possible to affix a bush 33 over the freewheel couplings 29, whereby the bush 33 is connected to the pump 23.

The bush 33 acts as it were as the drive shaft of the pomp 23, whereby it must be noted that the bush 33 will follow the movement, i.e. the rotation at a certain speed, of either the first shaft 9 or the second shaft 27 depending on the speed of the shafts 9, 27.

It is clear that in this way the first and second disengageable couplings 24, 28 are such that the pump 23 is only driven by the shaft of the two shafts 9, 27 that has the highest speed.

The operation of the device 1 is very simple and as follows.

During operation, the motor 8 will drive the first shaft 9. The shaft 10 of the impellers 4 will be driven via the transmission 11, such that the impellers 4 will rotate.

The impellers 4 will hereby draw in air through the inlet 5 and compress it.

The compressed air will leave the compressor device 1 via the outlet 6.

Due to the movement of the first shaft 9 the pump 23 will also be driven by this first shaft 9.

Indeed, during the operation of the compressor device 1 the secondary drive 25 is not operating because the auxiliary motor 26 is switched off.

This means that the second shaft 27 is not rotating.

As the first shaft 9 will indeed rotate at a certain speed, the freewheel couplings 29 on this first shaft 9 will ensure a coupling between the first shaft 9 and the pump 23.

The freewheel couplings 29 on the second shaft 27 will disengage the pump 23 from the second shaft 27, as the pump 23 will rotate at a higher speed than the second shaft 27.

In other words: the first disengageable coupling is engaged, while the second disengageable coupling is disengaged or uncoupled.

The pump 23 is driven by the first shaft 9 of the drive 7, such that oil will be pumped around in the oil circuit 16 from the oil reservoir 17, so that oil is brought into the housing 3 via the inlet 19 for oil, more specifically in the space 13 in which the gearwheels 12 are located.

Hereby the oil first passes through the cooler 21 and the filter 22 to cool the oil if desired and to filter any impurities out of the oil.

The oil will return to the oil reservoir 17 via the outlet 20 for oil.

At the moment that the compressor device 1 is switched off, in the first instance the secondary drive 25 will be started up. The speed of the second shaft 27 will hereby increase.

Then the drive 7 is switched off, such that the speed of the motor 8 and thus the first shaft 9 will decrease.

For as long as the speed of the first shaft 9 is higher than the second shaft 27, the first disengageable coupling 24 will ensure that the pump 23 is driven by the first shaft 9.

At the moment that the speed of the first shaft 9 is lower than the speed of the second shaft 27, the first disengageable coupling 24 will be disengaged and the second disengageable coupling 28 will be engaged.

Because in this case use is made of freewheel couplings 29, this changeover from the first shaft 9 to the second shaft 27 will be done automatically without any intervention of a controller or regulator.

In other words the determination of the speeds of the first shaft 9 and the second shaft 27 and the comparison of those speeds will be done without the intervention of a controller, regulator or similar.

When the drive 7 is fully switched off, and thus the speed of the first shaft 9 and the impellers 4 is equal to zero, the pump 23 will still be driven by the auxiliary motor 26.

As a result while switching off, the necessary oil will still be injected into the housing 3.

The auxiliary motor 26 can be switched off at the moment that the drive 7 has completely stopped.

When the compressor device 1 has to be started up, in the first instance the secondary drive 25 will be started up.

The pump 23 is then driven by the second shaft 27, such that oil is injected into the housing 3, already before the actual start-up of the compressor device 1.

Then the motor 8 is started up, such that the drive 7 comes into operation.

In this way it can be ensured that the gearwheels 12 of the drive 7 are already lubricated before the compressor device 1 is started up.

In the first instance the pump 23 will still be driven by the auxiliary motor 26.

Only at the time that the first shaft 9 has a higher speed than the second shaft 27, the second disengageable coupling 28 will be disengaged and the first disengageable coupling 24 will be engaged, due to the action of the freewheel couplings 29, so that the pump 23 is driven by the first shaft 9.

At this moment the secondary drive 25 with the auxiliary motor 26 can be switched off.

It is clear that such a method will ensure that the changeover from the drive 7 to the secondary drive 25 in order to drive the pump 23 will proceed seamlessly, and that the supply of oil or the quantity of oil that is injected will present practically no fluctuations, if at all.

FIG. 3 shows an alternative embodiment of FIG. 2, whereby the coupling between the pump 23, the first shaft 9 and the second shaft 27 is implemented in a similar way.

In this case the first and the second disengageable coupling 24, 28 are realised by means of switchable couplings.

A first switchable coupling is between the pump 23 and the first shaft 9, a second switchable coupling is between the pump 23 and the second shaft 27.

Activation means are hereby provided that ensure that either the disengageable coupling 24 with the first shaft 9 or the disengageable coupling 28 with the second shaft 27 is realised.

These activation means can be a controller 34 for example, such as a hydraulic controller, or an electronic circuit that determines which disengageable coupling 24, 28 must come into operation on the basis of the speeds of the first shaft 9 and the second shaft 27.

In the example shown, the couplings are realised by means of friction plates 35 on the first shaft 9 and second shaft 27 and coupling plates 36 mating therewith that are affixed on the pump 23, whereby the coupling plates 36 are movable with respect to the friction plates 35.

The controller 34 will hereby control the movement of the coupling plates 36.

To this end the controller 34 will determine the speed of the first shaft 9 and the second shaft 27 and compare these speeds.

When the speed of the second shaft 27 is greater than the speed of the first shaft 9, the controller 34 will ensure that the first disengageable coupling 24 is disengaged, by moving the coupling plate 36 away from the friction plate 35 of the first shaft 9.

The other coupling plate 36 will be moved to the friction plate 35 of the second shaft, such that the second disengageable coupling 28 is engaged.

However, when the speed of the second shaft 27 is less than the speed of the first shaft 9, the controller 34 will ensure that the second disengageable coupling 28 is disengaged, by moving the coupling plate 36 away from the friction plate 35 of the second shaft 27.

The other coupling plate 36 will be moved to the friction plate 35 of the first shaft 9, so that the first disengageable coupling 24 is engaged.

The further operation is analogous to the embodiment described above.

Another possibility is that the first shaft 9 and the second shaft 27 are not in line with one another, for example by making use of gearwheel transmissions between the pump 23 and the first shaft 9 and between the pump 23 and the second shaft 27, whereby a switch or similar is provided that ensures that either the gearwheels of the one gearwheel transmission, or the gearwheels of the other gearwheel transmission mesh together.

This switching will be done on the basis of the determined speed of the shafts 9 and 27, similar to the example of FIG. 3.

The present invention is by no means limited to the embodiment described as an example and shown in the drawings, but a compressor device according to the invention and a method for providing a compressor device with oil can be realised in all kinds of variants without departing from the scope of the invention.

The invention claimed is:

1. A compressor device for compressing gas that comprises:

a compressor element comprising a housing having a fluid inlet and a fluid outlet, at least one rotor affixed in the housing, and a drive for driving the at least one rotor, said drive comprising a motor and a transmission coupled to the at least one rotor and the motor, and an oil circuit for injecting oil into the housing, wherein the oil circuit only comprises a single pump for driving the oil around in the oil circuit, wherein the single pump is coupled to a first shaft via a first disengageable coupling, said first shaft being coupled to the motor of the drive and to a second shaft via a second disengageable coupling, said second shaft being coupled to a secondary drive, wherein the first and second disengageable couplings between the single pump and the first shaft and between the single pump and the second shaft are configured in a way such that the single pump is driven by the first shaft or the second shaft that has the highest speed.

2. The compressor device according to claim 1, wherein the first disengageable coupling between the pump and the first shaft is realised by means of at least one freewheel coupling that is affixed on the first shaft, and that the second disengageable coupling between the pump and the second shaft is realised by means of at least one freewheel coupling that is affixed on the second shaft, wherein the freewheel couplings are configured such that the pump is only driven by the first shaft or the second shaft that has the highest speed by disengaging the first shaft or the second shaft from the pump that has a lower speed.

3. The compressor device according to claim 2, wherein the first shaft and the second shaft are aligned along a same axis of rotation.

4. The compressor device according to claim 3, wherein a bush is affixed over the freewheel couplings, said bush being connected to the pump.

5. The compressor device according to claim 2, wherein the first disengageable coupling between the pump and the first shaft comprises two freewheel couplings that are affixed on the first shaft.

6. The compressor device according to claim 1, wherein the first and second disengageable couplings between the pump, the first shaft and the second shaft comprise switchable couplings between the pump and the first shaft and between the pump and the second shaft, wherein activation means are provided that ensure that either the coupling with the first shaft or the coupling with the second shaft is realised.

7. The compressor device according to claim 1, wherein the transmission is in the housing of the compressor device.

8. The compressor device according to claim 1, wherein the compressor element comprises a centrifugal compressor element, wherein the rotor is an impeller.

9. A method for providing a compressor device with oil by means of a pump, wherein the pump is coupled to a first shaft of a drive via a first disengageable coupling, wherein said drive comprises a motor and a transmission and drives a rotor of the compressor device, and is coupled to a second shaft of a secondary drive via a second disengageable coupling, the method comprising the following steps:

disengaging the first disengageable coupling to disengage the first shaft from the pump and engaging the second disengageable coupling to engage the second shaft with the pump when the speed of the second shaft is greater than the speed of the first shaft;

disengaging the second disengageable coupling to disengage the second shaft from the pump and engaging the first disengageable coupling to engage the first shaft with the pump when the speed of the second shaft is less than the speed of the first shaft.

10. The method according to claim 9, wherein during the start-up of the compressor device the method comprises the following steps:

the start-up of the secondary drive;

then the start-up of the drive;

when the pump is coupled to the first shaft, the secondary drive is switched off.

11. The method according to claim 10, wherein during the switch-off of the compressor device the method comprises the following steps:

the start-up of the secondary drive;

the switch-off of the drive;

the switch-off of the secondary drive when the drive has completely stopped.

12. A compressor device comprising:

a compressor element comprising a housing with an inlet and an outlet, and at least one rotor affixed in the housing, and a drive for driving the at least one rotor, said drive comprising a motor and a transmission coupled to the at least one rotor and the motor, and an oil circuit for injecting oil into the housing, said oil circuit comprising a single pump configured to drive the oil around in the oil circuit, and wherein said single pump is coupled to a first shaft via a first disengageable coupling, said first shaft being coupled to the motor of the drive, and to a second shaft via a second disengageable coupling, said second shaft being coupled to a secondary drive on the other hand, and wherein the first and second disengageable couplings between the single pump and the first shaft and between the single pump and the second shaft are configured such that the single pump is driven by the first shaft or the second shaft that has the highest speed, and wherein the first shaft and the second shaft are aligned along a same rotation axis of the first shaft and the second shaft.

13. A compressor comprising a housing comprising a fluid inlet and a fluid outlet, at least one rotor affixed in the housing, and a drive for driving the at least one rotor, said drive comprising a motor and a transmission coupled to the at least one rotor and the motor, oil, and an oil circuit for injecting oil into the housing, wherein the oil circuit comprises a single pump for driving the oil in the oil circuit, wherein the single pump is coupled to a first shaft via a first disengageable coupling, said first shaft being coupled to the motor, and the single pump is coupled to a second shaft via a second disengageable coupling, said second shaft being coupled to a secondary drive, and wherein the first disengageable coupling and the second disengageable coupling are configured in a way such that the single pump is driven by the first shaft or by the second shaft.

14. The compressor of claim 13, further comprising a controller to engage and disengage the first disengageable coupling and the second disengageable coupling on the basis of speeds of the first shaft and the second shaft.

* * * * *